US011090659B2

(12) United States Patent
Venturi et al.

(10) Patent No.: US 11,090,659 B2
(45) Date of Patent: Aug. 17, 2021

(54) CONTROL METHOD OF A CRUSHER AND A CRUSHER OF ELEMENTS TO BE RECYCLED OR DISPOSED

(71) Applicant: CAMS S.r.l., Castel San Pietro Terme (IT)

(72) Inventors: Marco Venturi, Bologna (IT); Mauro Biavati, Ferrara (IT)

( * ) Notice: Subject to any disclaimer, the term of this patent is extended or adjusted under 35 U.S.C. 154(b) by 122 days.

(21) Appl. No.: 16/490,111

(22) PCT Filed: Feb. 23, 2018

(86) PCT No.: PCT/IB2018/051130

§ 371 (c)(1),
(2) Date: Aug. 30, 2019

(87) PCT Pub. No.: WO2018/158668

PCT Pub. Date: Sep. 7, 2018

(65) Prior Publication Data

US 2020/0009575 A1 Jan. 9, 2020

(30) Foreign Application Priority Data

Mar. 2, 2017 (IT) ..... 102017000023369

(51) Int. Cl.
*B02C 25/00* (2006.01)
*B02C 18/22* (2006.01)
*B02C 13/286* (2006.01)

(52) U.S. Cl.
CPC ..... *B02C 25/00* (2013.01); *B02C 18/2275* (2013.01); *B02C 13/286* (2013.01); *B02C 18/2233* (2013.01); *B02C 2013/28627* (2013.01)

(58) Field of Classification Search
CPC ..... B02C 18/2233; B02C 18/06; B02C 18/24; B02C 18/142; B02C 2018/164;
(Continued)

(56) References Cited

U.S. PATENT DOCUMENTS 3,134,939 A * 5/1964 Eddy ..... B65G 47/1478 318/475
4,295,420 A * 10/1981 Satake ..... B02B 3/045 99/486

(Continued)

FOREIGN PATENT DOCUMENTS

JP 2004305860 A * 11/2004

OTHER PUBLICATIONS

Machine translation of JP 2004305860, Translated Jan. 8, 2020, 3 Pages (Year: 2004).*

*Primary Examiner* — Gregory D Swiatocha
(74) *Attorney, Agent, or Firm* — Themis Law

(57) ABSTRACT

A control method of a crusher for elements to be recycled or disposed of, which includes a crushing assembly, to which the elements to be recycled or disposed of are provided, and pushers acting toward the crushing assembly to push the elements to be recycled or disposed of, includes a measuring step of the current absorbed by the crusher, a comparing step of the current value measured against a first predetermined value, and a reducing step of the push intensity of one or more of the pushers toward the crushing assembly in case the measured current exceeds the first predetermined value, the pushers being controlled separately from each other in order to partialize the push force and the push areas.

3 Claims, 2 Drawing Sheets

(58) Field of Classification Search
CPC ..... B02C 2201/02; B02C 2013/28627; B02C 18/2275; B02C 18/2225; B02C 2013/28618; B02C 23/02
See application file for complete search history.

(56) References Cited

U.S. PATENT DOCUMENTS

| | | | | |
|---|---|---|---|---|
| 4,844,363 | A * | 7/1989 | Garnier | B02C 18/2233 241/224 |
| 6,016,979 | A * | 1/2000 | Squires | B02C 18/145 241/280 |
| 6,491,240 | B1 | 12/2002 | Veeck | |
| 8,360,349 | B1 * | 1/2013 | Sotsky | B02C 13/286 241/33 |
| 2006/0016919 | A1 * | 1/2006 | Castronovo | B02C 18/0007 241/34 |
| 2013/0284837 | A1 * | 10/2013 | Cochran | B02C 18/2275 241/101.5 |
| 2018/0043367 | A1 * | 2/2018 | Tsai | B02C 25/00 |

* cited by examiner

CONTROL METHOD OF A CRUSHER AND A CRUSHER OF ELEMENTS TO BE RECYCLED OR DISPOSED

DEFINITIONS

In the present invention, the term "elements to be recycled or disposed of" means construction residual materials, road residual materials, foundry wastes, mineral processing wastes, glass processing wastes, plastic processing wastes, or the like.

FIELD OF APPLICATION

The present invention is generally applicable to the technical field of the disposal of processing or dismantling residues of buildings, objects, plants, and refers to the treatment of elements to be recycled or disposed of such as debris deriving from the demolition of buildings, or from the removal or reconstruction of different works, or the like, residues from metals, plastics, or glass processing, or the like.

More in detail, the present invention relates to a treatment plant for elements to be recycled or disposed of in order to reduce their size.

STATE OF THE ART

Even partial demolition of buildings due to restructuring or due to destructive events as well as the rebuilding of different works or other human works generates typically rubble having large sizes. They must obviously be disposed of, and often their size, combined with the corresponding weight they have, make this disposal complex, and sometimes very difficult.

In this sense, different types of machines for reducing the size of the rubble are known. First of all, the rubble crushers are known that allow to reduce large slabs, portions of beams, or the like, in boulders of smaller dimensions.

Typically, the crushers are provided with a loading hopper arranged above the milling cutters where the scrapers, cranes or the like can load the elements to be crushed.

With regard to the milling cutters, they are generally constituted by rotating units made by assembling coaxially together a plurality of disks provided with crushing teeth on the periphery. The disks are typically interspersed by spacers so that two rotors can be arranged frontally to each other and partially interpenetrate into each other by arranging the disks of the one in correspondence with the spacers of the other.

The pair of rotors is rotated in opposite directions so that with such rotation the teeth present on the periphery of the disks of a rotor cooperate with the teeth present on the periphery of the disks of the other rotor by gripping the elements to be recycled with each other and compressing them until the crushing thereof.

To avoid that there are elements to be recycled or disposed of that "float" above the milling cutters, and to optimize the crushing step, typically there are also pushers acting above the milling cutters by pushing the elements in their direction.

As with most machines, even in the case of crushers, a primary purpose is to avoid as much as possible the machine downtime because it drastically reduces the yield. In particular, in the case of crushers, stopping the machine takes a few seconds to completely stop the motors and then to restart them.

Such machines are subject to working stops, due to material that gets stuck between the milling cutters or to a failure, and, in any case, require continuous monitoring and intervention by operators to limit such occurrences. Since the machine downtime can occur various times in a day's work, it follows that at the end of the day the lack in productivity becomes significant.

Moreover, typically the crusher is the first processing station of a complex line. Consequently, a shut-down of the crusher requires a shut-down of the stations downstream due to the absence of material to be treated.

The result is therefore the complete stoppage of the processing line, resulting in a further decrease in the overall yield.

PRESENTATION OF THE INVENTION

The object of the present invention is to overcome at least partially the drawbacks noted above, providing a crusher for elements to be recycled or disposed of which allows reducing, if not zeroing, the risk of having to stop it during processing.

Another object of the invention is to provide a crusher which allows to avoid or minimize the presence of specialized personnel who monitor its operation.

In other words, an object of the present invention is to provide a crusher, which has a processing yield higher than the known equivalent crushers so as to minimize the costs in terms of personnel to be dedicated to its operation and in economic terms.

Such aims, as well as others which will be clearer below, are achieved by a control method of a crusher for elements to be recycled or disposed of according to the following claims, which are to be considered as an integral part of this patent.

In particular, the crusher controlled according to the method of the invention comprises at least one crushing assembly to which the elements to be recycled or disposed of are provided, and two or more pushers acting towards the crushing assembly for pushing the elements to be recycled or disposed of against the crushing assembly.

With the crusher for elements to be recycled or disposed of thus configured, the method of the invention comprises a measurement step, preferably but not necessarily by means of appropriate amperometric sensors, of the current absorbed by the crusher.

Then there is provided a comparison step of the measured value to a first predetermined value that corresponds to a pre-alarm value. If the comparison shows a current absorption higher than the pre-alarm value, then there is a reducing step of the intensity of the push that the pushers exert on the elements to be crushed present above the crushing assembly.

In addition, the pushers are controlled separately from each other in order to partialize the push force and the push areas.

Since the current absorption of the crusher for elements to be recycled or disposed of is proportional to the work it has to perform, if there is any material that is not suitable for processing and/or that slows down the crushing, the current absorption indicates the overload of the crushing assembly.

Since, as mentioned, the machine downtime is a detrimental event for the processing yield thereof, the decreasing of the pressure exerted by the pusher allows, advantageously, to decrease the load on the crushing assembly without slowing down its operation.

In other words, still advantageously, before the crusher is damaged or must be stopped due to overload, the method of the invention provides a first automatic intervention aimed at solving the problem or at giving the crushing assembly time to overcome the critical moment.

The decrease in the push exerted by the pushers, therefore, advantageously allows to simply slow down the production of the crusher for elements to be recycled or disposed of without the need to stop it. Moreover, the separate control of the pushers between each other, as mentioned, allows to partialize the push force and the push areas, so as to optimize the push reduction and in any case to maximize the production speed.

It is obvious, therefore, that in this way the productivity of the crusher, even if it comprises further upstream processing stations, is increased compared to the equivalent known crushers, since situations that require the total shutdown of all the machine are reduced.

From the above, it is evident that said objects are achieved by a crusher for elements to be recycled or disposed of, comprising:

- a crushing chamber in which the elements are crushed;
- at least one crushing assembly inserted in said crushing chamber for crushing the elements to be recycled or disposed of;
- at least one channel for conveying the elements to be recycled or disposed of towards said crushing assembly;
- two or more pushers acting in said conveying channel towards said crushing assembly to push the elements to be recycled or disposed of against said crushing assembly, and which is characterized by the fact that it also includes:

- at least one amperometric sensor for detecting the current absorbed by said crusher;
- at least one control circuit operatively connected to said amperometric sensor and at least to said pushers to decrease the push intensity in the case of a current measurement is greater than a first predetermined value, said pushers being controlled by said control circuit separately from each other in order to partialize the push force and the push areas.

Advantageously, inter alia, the presence of the control circuit allows to reduce, and possibly eliminate at all, the need for the presence of personnel in charge of controlling and managing the crusher of the invention with respect to what happens for the known equivalent crushers.

This still allows, advantageously, to further increase the yield of the crusher according to the invention by reducing operating costs.

BRIEF DESCRIPTION OF THE DRAWINGS

Further features and advantages of the invention will be more apparent in light of the detailed description of some preferred, but not exclusive, embodiments of a method of controlling a crusher for elements to be recycled or disposed of according to the invention, illustrated by way of non-limiting example with the aid of the accompanying drawings tables, wherein.

DETAILED DESCRIPTION OF AN EXEMPLARY PREFERRED EMBODIMENT

Figure 1:
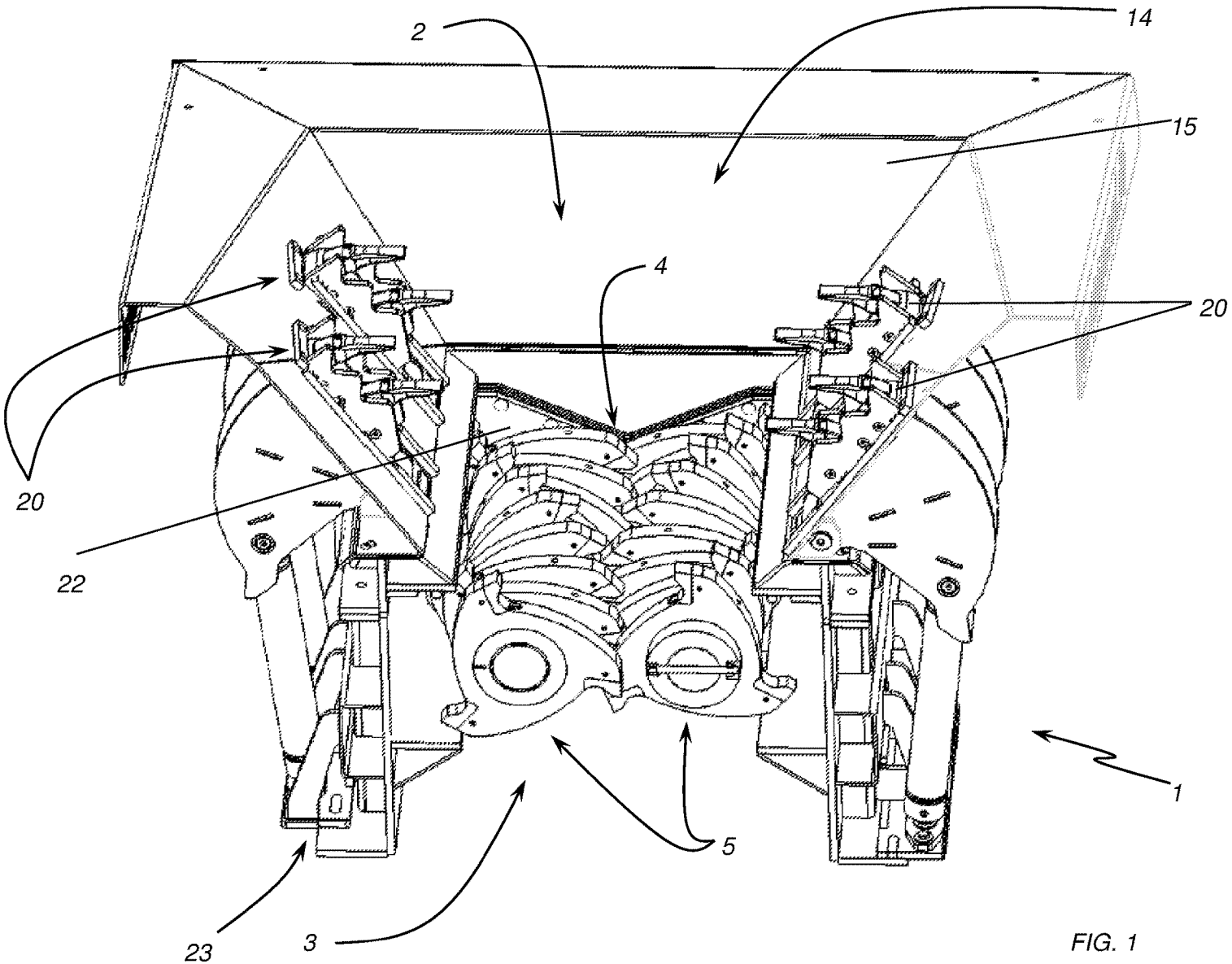
FIG. 1 represents a perspective, partially sectioned view of a rubble crusher according to the invention.

With reference to the figures above, and in particular to FIG. 1, a crusher 1 for elements to be recycled or disposed of according to the invention is described and suitable for being controlled by a method according to the invention. The crusher 1 is commonly used for crushing rubble deriving from the dismantling of masonry works, or other and similar works.

In this sense, it comprises a crushing chamber 2 in which the elements to be recycled or disposed of are crushed. To this end, in the crushing chamber 2 is present a crushing assembly 3.

Figure 2:
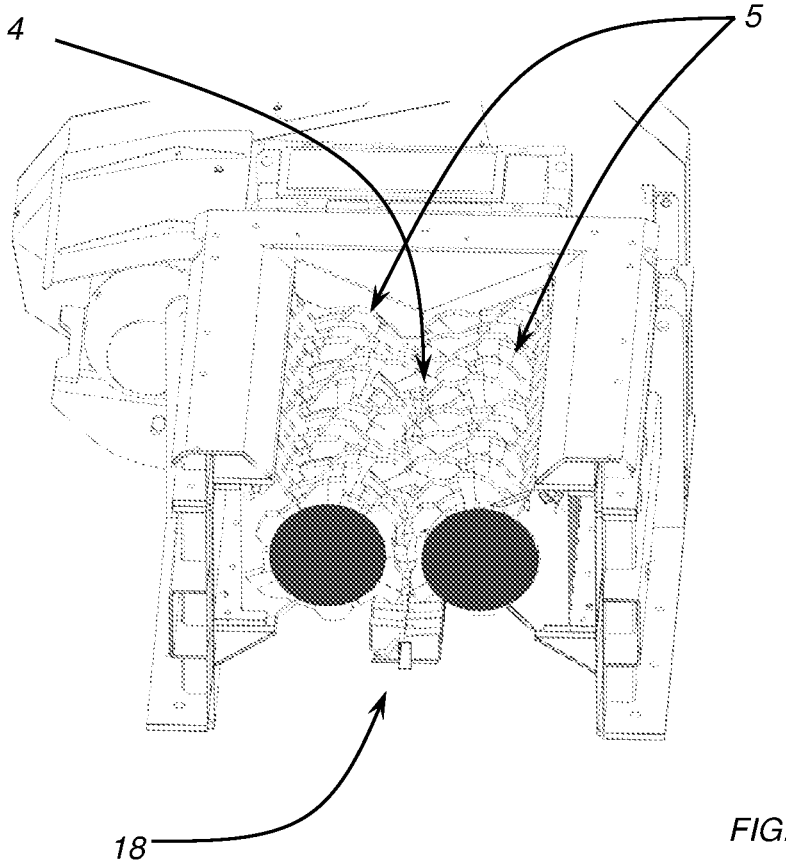
FIGS. 2 and 3 represent details of the rubble crusher of FIG. 1.

In the embodiment described, it consists of, as can be seen also in FIG. 2, a pair of milling cutters 5 arranged frontally to each other and at least partially interpenetrating into each other. Among these, a crushing area 4 of the elements to be recycled or disposed of can be identified.

Figure 3:
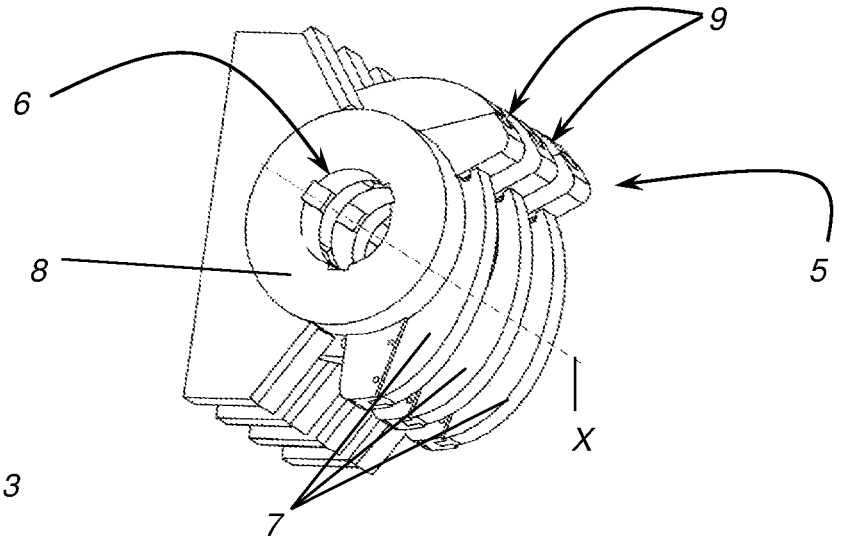

According to an aspect of the invention, each milling cutter 5 comprises, as shown in FIG. 3, a rotor 6 provided with a plurality of crushing disks 7. The latter are arranged coaxially with the rotation axis X of the rotor 6. Moreover, they are interspersed with spacers 8. In other words, between each adjacent pair of grinding disks 7 of each milling cutter 5 there is a slot 9 at a spacer 8. In this way, it is possible to partially interpenetrate the two milling cutters 5 arranged frontally so as a milling disk 7 of a milling cutter 5 is matched to a spacer 8 of the other.

Obviously, both the number of milling cutters and the effective embodiment of the crushing assembly or of the milling cutters are to be considered exemplary cases of the invention for different variant embodiments.

Also the number of crushing chambers and crushing assemblies are non-limiting characteristics for the invention.

According to another aspect of the invention, the crusher 1 also comprises a conveying channel 14 which, in the described embodiment, consists of a loading hopper 15 for receiving the elements to be recycled or disposed of and for directing them towards the inside of the crushing chamber 2 in the direction of the crushing assembly 3. In the figures the crusher 1 has a vertical operating configuration so that the elements to be recycled or disposed of are placed above the hopper 15 from which they slide towards the crushing assembly 3. Also this feature is to be considered non-limiting for different embodiments of the invention where the hopper is absent or where the working configuration of the crusher is inclined or even horizontal, or where in a hopper there is a further element of the conveying channel having another shape.

During operation, the two milling cutters 5 are then rotated in opposite directions so as to grasp the elements to be recycled or disposed of and to crush them.

Since the crusher 1 must provide crushed elements to be recycled or disposed with a smaller size than a predetermined size, typically it comprises a mechanism for adjusting this size. In the described exemplary embodiment, it consists of an additional shaft 18 arranged at the outlet of the two milling cutters 5 at a predetermined distance. In this way, the outgoing material, if it has excessive size, can not descend, but is held close to the two milling cutters 5, which continue with the crushing operation. Consequently, the distance between the additional shaft 18 and the milling cutters 5 determines the maximum size allowed for the elements to be recycled or disposed of at the outlet of the crushing assembly 3.

If among the elements to be recycled or disposed of sheet elements and/or particularly tough elements are present, they could not get access to the crushing zone 4, but "float" above it. This, as mentioned, would force operators to intervene.

In order to avoid this eventuality, the crusher 1 of the invention comprises two or more pushers 20 acting in the conveying channel 14 movable towards the crushing assembly 3 to push the elements to be recycled or disposed of against it.

In particular, the pushers 20 act on the elements to be recycled or disposed of by pressing them against the crushing assembly 3 so that they are totally crushed, in order to avoid advantageously their floatation.

According to another aspect of the invention, the crusher 1 also comprises an amperometric sensor 22 for measuring the current consumption of the crusher 1 itself, and a control circuit 23 operatively connected to the amperometric sensor 22 and to the pushers 20.

Since the current absorbed by the crusher 1 is directly dependent on the work it has to perform to crush the elements to be recycled or disposed of, it is an indicator of overload or particularly of the presence of tough elements being crushed.

Such cases are dangerous for the crusher 1 because it risks to be damaged or in any case to stop, resulting in a need for a stop of the machine in order to solve the problem. In case of failure, the damage is evident. In case of arrest due to simple overload, the damage consists in the previously mentioned unacceptable strong decrease in the yield of the same.

For this reason, if the measured current exceeds a first threshold value, the control circuit 23 acts on the pushers 20 to decrease the intensity of the push they exert.

In other words, advantageously, the overload of the crushing assembly 3 is immediately and automatically detected by means of the amperometric sensor 22.

Still advantageously, the control circuit 23 in this case automatically acts by limiting the push exerted by the pushers 20 thereby reducing the load on the crushing assembly 3.

This allows the latter not only to be subjected to a lower effort, but also to have time to dispose the elements to be recycled or disposed of, which are in excess and those excessively tough.

This often allows to overcome the problem without stopping the production of the crusher 1, but only by slowing it down.

In addition, the pushers 20 are controlled separately from each other in order to partialize the push force and the push areas. This separate control allows, therefore, to optimize the push reduction and maximize the production speed.

In this way, still advantageously, the productivity is increased with respect to the known equivalent crushers, since the situations which require it to stop are reduced. In the case of further downstream processing stations, however, they too will be able to continue working, even if at reduced rates, instead of having to be stopped as in the prior art.

Still advantageously, the presence of the control circuit 23 allows to reduce, and possibly eliminate at all, the need for the presence of personnel in charge of controlling and managing the crusher 1 of the invention with respect to what happens for the known equivalent plants.

This still allows, advantageously, to further increase the yield of the crusher 1 according to the invention by reducing operating costs.

Obviously, neither the number of amperometric sensors nor the number of control circuits should be considered as limiting of the invention. According to some variant embodiments, for example, the amperometric sensors are more than one and each associated with a respective milling cutter.

As previously mentioned, an object of the present patent is also the method of controlling the crusher 1 described above.

In particular, according to an aspect of the invention, it comprises a step of measuring the current absorbed by the crusher 1 and a step of comparing the current value measured to the first predetermined value, which is a pre-alarm threshold.

In the case the comparison provides an exceeding of the pre-alarm threshold, then there is provided a step of reducing the push intensity exerted by the pushers 20 so as to allow the crusher 1 to dispose of the excess material and/or excessively tough material, and to restore the correct operation of the crusher 1.

Subsequently, according to another aspect of the invention, the steps for measuring the absorbed current and comparing the value of the current measured to the first predetermined value are repeated.

If it is below the pre-alarm threshold, the adjustment of the pushers 20 is reset.

Otherwise, this means that the problem is more serious and therefore an opening step for at least one of the pushers is provided in order to zero their load to the crushing assembly 3.

In other words, a gradual discharge action of the crusher 1 is performed, first decreasing the push of one or more of the pushers 20 separately from one another and with intensities that are also different from each other, and then, if this is not sufficient, zeroing it at all.

This opening step is performed after a cycle of measurement steps of the repetitive current for a predetermined number of times without the current ever falling below the pre-alarm threshold.

If the measured current does not drop and even rises above a second predetermined value (corresponding to an alarm threshold), the control method of the invention provides first of all a step of stopping the crusher 1 to prevent it from damage.

At the same time as the arrest, there is also provided an opening step of all the pushers 20 not only to lighten the load on the crushing assembly 3, but also to be able to operate freely thereon.

According to a further aspect of the invention, moreover, after this stopping step there is a first inversion step of the operation of the crusher 1 for a predetermined time. In fact, the alarm situation could indicate the blockage of material too tough therewithin. The inversion of the processing could allow the release of this material from the crusher, releasing it.

Subsequently, the correct working direction of the crusher 1 is restored and the current absorbed by it is measured. In case the values are back in the norm, the normal functionality of the crusher 1 is restored.

Otherwise, the inversion step can be repeated several times. Obviously, even the number of times in which this repetition occurs can be any number, without any limit for the present invention.

If this is not sufficient, according to another aspect of the invention, the method also includes a step of modifying the calibration of the mechanism for adjusting the size of the elements to be recycled or disposed of in order to increase it. If this mechanism comprises the additional shaft 18, this modification is obtained by increasing the distance from the output of the milling cutters 5.

In this way, the downstream output of the material being processed is favored, even if it has an excessive size.

If even this step is not sufficient to restore acceptable absorbed current values, the method of the invention comprises a second inversion step of the processing of the crusher 1, which can also be repeated for any number of times without any limit for the present invention.

If at any time the absorbed current falls below the alarm and pre-alarm values, the configuration of the crusher 1 is restored. If not, then a user must intervene to restore it.

It is therefore evident that the complete shut-down, in combination with the user's intervention, occurs only in particular cases and that therefore the productivity of the crusher 1 is certainly increased compared to the known equivalent plants.

For this reason it is clear that the method of the invention of controlling a crusher for elements to be recycled or disposed of, as well as the crusher itself, achieve all the intended purposes.

In particular, it allows reducing, if not zeroing, the risk of having to stop it during processing.

It also makes it possible to avoid or minimize the presence of specialized personnel who monitor its operation.

Specifically, the crusher of the present invention has a processing yield higher than the known equivalent crushers so as to minimize the costs in terms of personnel to be dedicated to its operation and in economic terms.

The invention may be subject to many changes and variations, which are all included in the appended claims. Moreover, all the details may furthermore be replaced by other technically equivalent elements, and the materials may be different depending on the needs, without departing from the scope of protection of the invention defined by the appended claims.

The invention claimed is:

1. A control method of a crusher for elements to be recycled or disposed of, comprising:

a step of providing a crushing assembly having, a plurality of milling cutters, to which the elements to be recycled or disposed of are provided, and two or more pushers acting towards said crushing assembly to push the elements to be recycled or disposed of against said crushing assembly, each of the two or more pushers being rotatably coupled to an edge of the crushing assembly;

a measuring step of current consumed by said crusher;

a comparing step of a value of said measured current against a first predetermined value;

a reducing step of push intensity of said two or more pushers towards said crushing assembly from an original level if said value of said measured current exceeds said first predetermined value, said two or more pushers being controlled separately from each other in order to partialize a push force and push areas;

a step of repeating the measuring step of the current consumed by said crusher and the comparing step of the value of said measured current against said first predetermined value;

if the consumed current falls below said first predetermined value, a step of resetting said push intensity to said original level;

if the value of the measured current is higher than a second predetermined value, greater than the first predetermined value, a stopping step of the crusher;

a step of inverting operation of the crusher after the stopping step;

the said crushing assembly comprises an adjustment mechanism adapted to adjust a size of the elements to be recycled or disposed of exiting the crusher;

a modifying step of a calibration of the adjustment mechanism to increase the size of the elements to be recycled or disposed of exiting the crushing assembly if the value of the measured current is higher than the second predetermined value; and one or more further steps of the inverting operation of the crusher after the modifying step of the calibration of the adjustment mechanism.

2. The control method according to claim 1, further comprising an opening step of at least one of said two or more pushers, if after said reducing step of said push intensity, and after a predetermined number of measuring steps of said consumed current and comparing steps with said first predetermined value, the value of said measured current continues to be above said first predetermined value.

3. The control method according to claim 1, further comprising an opening step of said pushers simultaneously with said stopping step of said crusher.

* * * * *